United States Patent [19]

Crim et al.

[11] Patent Number: 4,755,657

[45] Date of Patent: Jul. 5, 1988

[54] METHOD OF HEATING AN OIL RESERVOIR OF A REFRIGERATION COMPRESSOR

[75] Inventors: James B. Crim, Lake Jackson; Richard B. Stallcup, Tyler, both of Tex.

[73] Assignee: American Standard Inc., New York, N.Y.

[21] Appl. No.: 942,113

[22] Filed: Dec. 16, 1986

[51] Int. Cl.[4] ..... H05B 3/06

[52] U.S. Cl. ..... 219/536; 219/311

[58] Field of Search ..... 219/205, 208, 535, 311, 219/544, 536

[56] References Cited

U.S. PATENT DOCUMENTS

| | | | |
|---|---|---|---|
| 1,806,512 | 5/1931 | Wiegand | 219/436 |
| 2,158,681 | 5/1939 | Schulte | 219/315 |
| 4,091,267 | 5/1978 | Grant | 219/536 |

FOREIGN PATENT DOCUMENTS

| | | | |
|---|---|---|---|
| 589492 | 3/1959 | Italy | 219/311 |

*Primary Examiner*—Harold Broome

*Attorney, Agent, or Firm*—William J. Beres; David L. Polsley; Robert J. Harter

[57] ABSTRACT

A method for vaporizing the refrigerant trapped in the oil reservoir of a hermetic compressor. The refrigerant is vaporized by heat from a small pill shaped PTC heater (positive temperature coefficient heater) simply attached with adhesive tape in a shallow depression disposed near the bottom of the reservoir. The depression, formed on the compressor shell as a seamless indentation, extends into the reservoir and has a concave shape that conforms to the external surface of the heater. This provides a strong and hermetically sealed integral heater fixture having close fitting heat conductive contact with its associated heater element. The heater, being disposed in the shallow indentation, is placed in more direct contact with the liquid refrigerant, which tends to settle at the bottom of the reservoir due to its density being greater than that of the oil. In addition, because the PTC heater has a positive temperature coefficient, higher temperature levels are obtained when the heater is mounted in a shallow indentation versus a deep well. A shallow indentation exposes a portion of the PTC heater to ambient air which is less heat conductive than liquid refrigerant or oil. With less heat conducted from the heater, its temperature rises which provides a higher concentration of heat at the bottom of the shell. Moreover, the higher temperature increases the resistance of the PTC heater and thus reduces its power consumption.

5 Claims, 1 Drawing Sheet

METHOD OF HEATING AN OIL RESERVOIR OF A REFRIGERATION COMPRESSOR

TECHNICAL FIELD

This invention generally pertains to a method of vaporizing the refrigerant trapped in the oil reservoir of a hermetic compressor, and specifically to a method of vaporizing the refrigerant by attaching a pill shaped PTC heater (having a positive temperature coefficient) to a seamless indentation on the outer shell of the compressor.

BACKGROUND OF THE INVENTION

In a heat pump system it is often desirable to heat the oil reservoir of a hermetic compressor to vaporize any refrigerant condensate accumulating in the reservoir. This becomes especially important when operating the system in the heating mode under cold ambient conditions, because cold ambient air condenses the refrigerant which dilutes the oil. Heating the oil in the reservoir vaporizes the refrigerant and consequently removes it from the oil reservoir.

Present attempts at maximizing heat transfer to the oil and refrigerant involve inserting a heater deeply into a fabricated heater well that extends to the center of the oil reservoir. The well is generally in the shape of a cylindrical tube closed at one end, and extending its closed end through the compressor shell and into the oil reservoir, requires machining a hole through the shell. The open end of the well must be carefully welded to the perimeter of the hole to obtain a hermetic seal.

Even though the heater is located generally near the center of the oil reservoir, this is not the most effective location for vaporizing condensed refrigerant. Typically, condensed refrigerant is heavier than oil and settles at the bottom of the reservoir. With the heater near the center of the reservoir, heat must raise the temperature of a relatively long heater well and transfer through the oil before heating the refrigerant.

The central location becomes an even greater problem when a PTC heater (heater having a positive temperature coefficient) is used during cold start-up conditions. The PTC heater's resistance, which increases with an increase in temperature, is relatively low when the heater is centrally located and surrounded by cold, heat conductive oil. The low resistance increases the heater's wattage ($V^2/R$). This wasteful increase in power consumption heats the oil and also the relatively long heater well before indirectly heating the condensed refrigerant.

Therefore, an object of this invention is to more directly heat the refrigerant condensate in the oil reservoir of a hermetic compressor.

Another object is to mount a conventional PTC heater so that it heats at a higher temperature yet consumes less wattage.

Another object is to mount an oil heater in a fixture that is relatively easy and inexpensive to manufacture.

Yet another object is to provide a seamless indentation that is stronger and less likely to leak than a conventional fabricated well.

Still another object is to provide a heater fixture that only requires adhesive tape to mount its associated heater in place.

These and other objects will be apparent from the attached drawings and the description of the preferred embodiments that follow below.

SUMMARY OF THE INVENTION

The subject invention is a method of attaching an electric oil heater to the outer shell of a hermetic compressor. The method includes forming a seamless indentation on the shell such that the indentation protrudes into an oil reservoir contained within the shell. The heater is fastened to the exterior of the shell and against the indentation either by using an appropriate adhesive, by applying adhesive tape over both the heater and the shell, or by mounting a bracket to the shell and against the heater.

DESCRIPTION OF THE PREFERRED EMBODIMENTS

Figure 1:
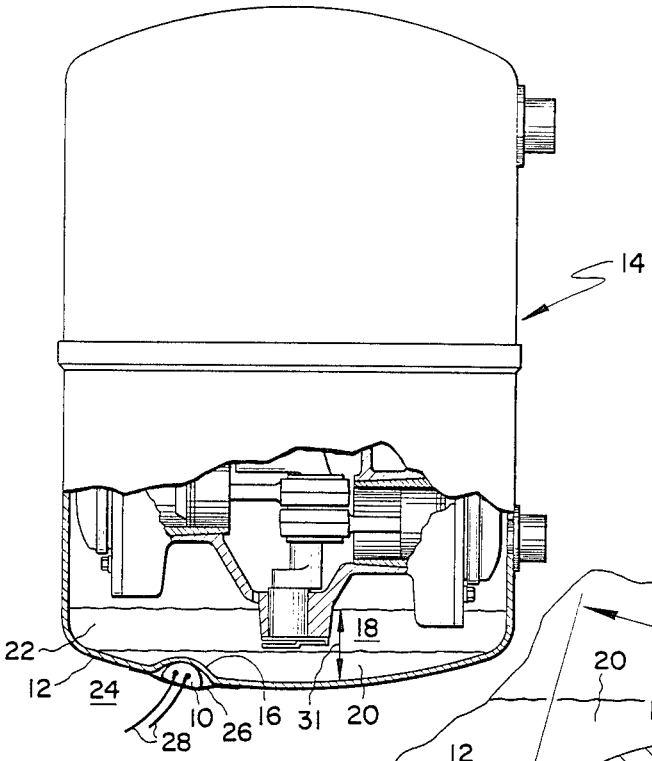
FIG. 1 is a cutaway view of a hermetic compressor with an oil heater attached to its outer shell by the method of the subject invention.
Figure 2:
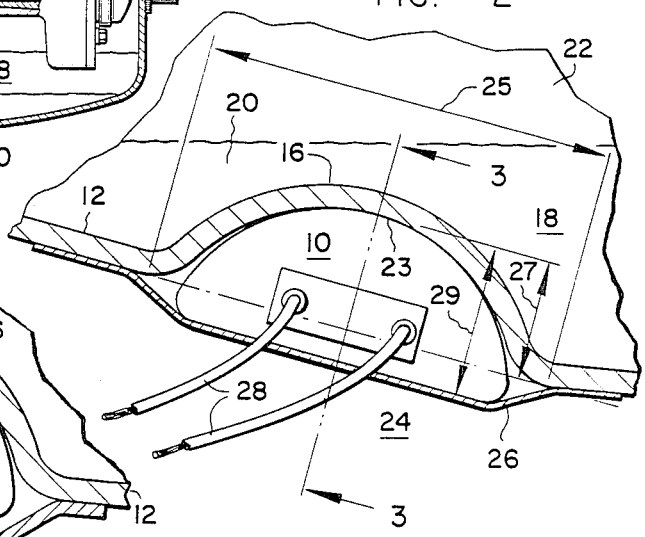
FIG. 2 is an enlarged view of the PTC heater shown in FIG. 1.
Figure 3:
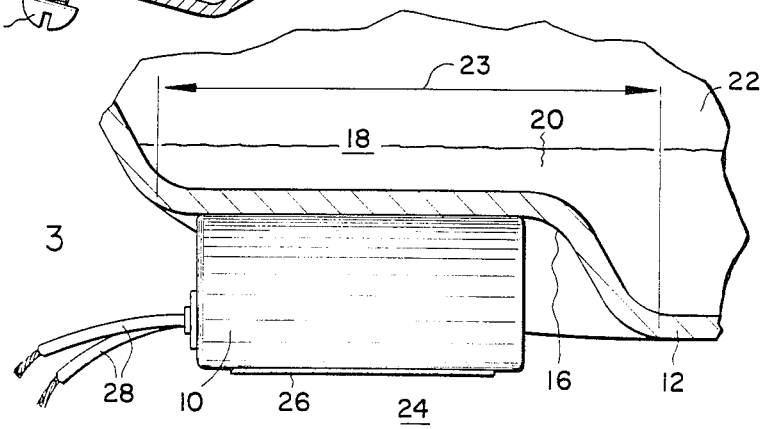
FIG. 3 shows a cross section of the heater shown in Figure 2, taken along section lines 3—3.

FIGS. 1, 2 and 3 show an electric heater 10 attached to an outer shell 12 of a hermetic refrigeration compressor 14 by the method of the subject invention. The method includes forming a seamless indentation 16 in shell 12 for oil heater 10. Indentation 16 is formed near the bottom of oil reservoir 18, where liquid refrigerant 20 is likely to settle below the oil 22. Indentation 16 is a seamless depression, i.e. a depression free of any joints, weld seams, or abrupt 90° edges, which thus minimizes stress concentrations and maintains the hermetic integrity of shell 12.

In the indentation forming process, which can be accomplished while forming shell 12 itself, a conventional die is used to produce a depression having a generally concave contour 23. Concave contour 23 is located at the bottom end of indentation 16 and generally matches the exterior surface of heater 10. Although in the preferred embodiment heater 10 is elongated with D-shaped cross section, indentation 16 can be formed to match other heaters having a variety of other shapes such as cylindrical, hemispherical, or generally rectangular.

Although heater 10 can be a constant wattage type heater, in the preferred embodiment heater 10 has a positive temperature coefficient, whereby its resistance increases with an increase in temperature. This quality causes heater 10 to be self-regulating. As the temperature of oil 22 and refrigerant 20 rises, so does the temperature of heater 10. This causes the electrical resistance of heater 10 to increase which decreases its power consumption.

Heater 10 is preferably mounted in a shallow depression, e.g., a depression having at least one span 23 or 25 greater than its depth 27, or a depression having a depth 27 that is less than the height 29 of heater 10, or a depression having a depth 27 that is less than half the liquid level in reservoir 18. A shallow depression exposes a portion of heater 10 to ambient air 24 which generally has lower thermal conductivity than the oil 22, refrigerant 20, and steel shell 12 of oil reservoir 18. The thermal insulating property of air maintains heater 10 at a higher temperature than if it were disposed deep within a thermally conductive well surrounded by liquid. The higher temperature produces a higher concentration of heat at indentation 16. In addition, the rate of heat transfer is further improved by applying a thermally conductive grease, or similar compound, between the mating surfaces of heater 10 and indentation 16.

Figure 4:
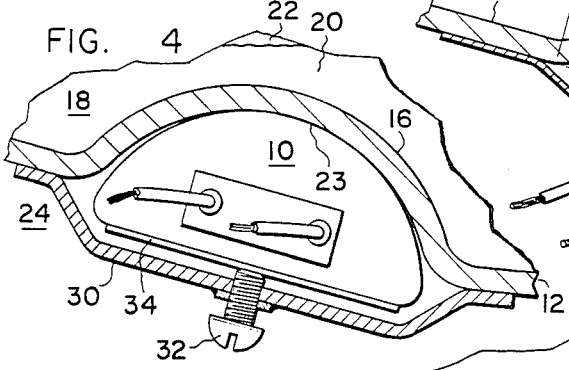
FIG. 4 shows a bracket holding the heater to the seamless oil well.

Heater 10 is attached to indentation 16 by applying adhesive tape 26 over the heater and against shell 12. Electrical leads 28 extend from heater 10 and are made available for connection to an electrical power supply. Although adhesive tape 26 is used in the preferred embodiment, it should be appreciated that any appropriate adhesive, slip, or other mechanical fastener could also be used to attach heater 10. For example, in another embodiment, FIG. 4 shows a bracket 30 extending over heater 10 and spot welded to shell 12. Screws 32 are tightened against heater 10 to hold in it place. The holding force applied by screws 32 is evenly distributed over heater 10 by a metal shim 34 interposed between the heater and screws 32.

Although the invention is described with respect to more than one embodiment, modifications thereto will become apparent to those skilled in the art. Therefore, the scope of the invention is to be determined by reference to the claims which follow.

We claim:

1. A refrigeration apparatus comprising:

(a) A hermetic shell having an underside with a primarily convex exterior surface and having an interior isolated from atmosphere, said interior defining a reservoir containing a separable mixture of oil and liquid refrigerant, with said refrigerant having a higher specific gravity than said oil;

(b) a refrigeration compressor disposed inside said shell;

(c) a seamless indentation protruding into said shell, said indentation being disposed at said underside of said shell and extending to a shallow depth to directly heat liquid refrigerant that may separate from said mixture and settle at the bottom of said reservoir, and to directly heat said oil in the absence of accumulated liquid refrigerant at the bottom of said reservoir, said indentation having at least one span that is greater than said depth with said depth being less than half the liquid level of said mixture of oil and liquid refrigerant; and (d) a PTC heater having an electrical resistance that increases with temperature, said PTC heater being attached to said indentation and having a convex surface that generally conforms to and engages a mating concave surface of said indentation.

2. The refrigeration apparatus as recited in claim 1, wherein said depth is less than a height of said PTC heater.

3. The refrigeration apparatus as recited in claim 1, wherein said PTC heater is attached to said indentation with a mechanical fastener.

4. The refrigeration apparatus as recited in claim 1, wherein said PTC heater is attached to said indentation with adhesive.

5. The refrigeration apparatus as recited in claim 4, wherein said PTC heater is attached to said indentation with adhesive tape.

* * * * *